United States Patent [19]

Sokn et al.

[11] Patent Number: 4,914,781

[45] Date of Patent: Apr. 10, 1990

[54] HINGE ASSEMBLY FOR A CLOSURE MEMBER

[75] Inventors: Erick L. Sokn, Carbondale; Willis E. Harlow, Herrin, both of Ill.

[73] Assignee: Maytag Corporation, Newton, Iowa

[21] Appl. No.: 289,679

[22] Filed: Dec. 27, 1988

[51] Int. Cl.[4] ..... E05D 1/04

[52] U.S. Cl. ..... 16/225; 16/280; 16/297; 16/303; 16/319; 16/325; 16/334; 16/341; 16/385; 16/388; 16/DIG. 13; 16/356; 220/335; 68/2; 68/3 R

[58] Field of Search ..... 16/225, 321, 325, 337, 16/341, 344, 355, 356, 385, DIG. 13, 250, 334, 348, 376, 388, DIG. 29, 227, 243, 280, 284, 297, 303; 220/336, 337, 338, 339, 335, 377; 49/397, 399; 68/2, 3 R

[56] References Cited

U.S. PATENT DOCUMENTS

| | | | |
|---|---|---|---|
| 616,258 | 12/1898 | Rembold . | |
| 2,353,671 | 7/1944 | Karish . | |
| 2,660,273 | 11/1953 | Rogers . | |
| 3,378,880 | 4/1968 | Haldopoulos et al. . | |
| 3,474,470 | 10/1969 | Watson . | |
| 3,581,527 | 6/1971 | Smith et al. . | |
| 3,621,165 | 11/1971 | Stone . | |
| 3,931,663 | 1/1976 | Holmes et al. . | |
| 3,952,369 | 4/1976 | Erickson . | |
| 4,115,901 | 9/1978 | Schmidt | 16/DIG. 13 |
| 4,521,937 | 6/1985 | Fisher | 16/355 |
| 4,630,332 | 12/1986 | Bisbing . | |
| 4,734,955 | 4/1988 | Connor | 16/341 |
| 4,783,111 | 11/1988 | Hemmeke et al. | 16/355 |
| 4,787,121 | 11/1988 | Racenis et al. | 16/356 |
| 4,794,669 | 1/1989 | Sanders | 16/344 |

*Primary Examiner*—Nicholas P. Godici
*Assistant Examiner*—Edward A. Brown
*Attorney, Agent, or Firm*—Bacon & Thomas

[57] ABSTRACT

A hinge assembly for pivotally connecting a closure lid to the cabinet of a top loading clothes washing machine and maintaining the lid in a releasable self-sustaining open position and out of contact with the knobs of the machine control panel. The assembly includes an integrally formed first hinge portion for attachment to the cabinet and provided with a base, a curved bearing surface terminating in a landing and a pivotal hub, and a second hinge portion for attachment to the closure lid and provided with a pivot pin disposable within a passageway formed in the hub. A pair of the assemblies are used to secure a closure lid provided with a radiused bearing section to the cabinet.

14 Claims, 3 Drawing Sheets

HINGE ASSEMBLY FOR A CLOSURE MEMBER

BACKGROUND OF THE INVENTION

1. Field of the Invention

The invention generally involves the field of technology pertaining to hinge structures for pivotally attaching a closure lid to an associated cabinet. More specifically, the invention relates to an improved hinge assembly for pivotally securing a closure lid to the cabinet of a top loading clothes washing machine and maintaining the lid in a releasable self-sustaining open position.

2. Description of the Prior Art

A conventional top loading clothes washing machine includes a cabinet provided with a closure lid that is hinged along an edge thereof adjacent to the top rear portion of the cabinet so that the lid may be pivoted upwardly and rearwardly to permit access into the interior of the clothes basket. A vertically extending control panel is normally positioned behind the closure lid for supporting control members, such as knobs and buttons, which protrude outwardly from the panel in a generally forward direction towards the front of the cabinet. The closure lid may be freely hinged to the cabinet so that it can be maintained in a fully open position by pivoting same overcenter and backwardly into a resting position of engagement against the control members of the control panel. This is an undesirable situation which, after a period of use, may result in damage to the control members and closure lid.

It is known to provide a hinge structure which permits the closure lid of a clothes washing machine to be releasably retained in an open position. It is also generally well known to provide closure members associated with different types of cabinet structures with devices for releasably maintaining such members in a partial or fully open position, with such devices being particularly incorporated in combination with a hinge structure.

SUMMARY OF THE INVENTION

It is an object of the invention to provide an improved hinge assembly for connecting a closure member to a cabinet and permitting the closure member to pivot between a closed position and a releasable self-sustaining open position.

It is another object of the invention to provide an improved hinge assembly for pivotally connecting a closure lid to the cabinet of a top loading clothes washing machine whereby the closure lid may be disposed in a releasable self-sustaining open position and out of contact with control members of the machine control panel.

It is a further object of the invention to provide an improved hinge assembly for maintaining a pivotal closure lid in a releasable self-sustaining position wherein the assembly is of simple construction, economical to manufacture and easy to install.

These and other objects of the invention are realized by providing a hinge assembly that includes first and second hinge portions for respective attachment to the cabinet of a clothes washing machine and its closure lid. The first hinge portion is provided with a pivotal hub having a passageway formed therein for receiving a corresponding pivot pin carried by the second hinge portion. The first hinge portion also includes a curved bearing surface terminating in a landing and configured for permitting a smooth transition from a clearance to an interference fit for a radiused bearing section formed between the return and depending flanges of the closure lid. When the bearing section is engaged within the landing, the closure lid is maintained in a self-sustaining open position in front of and out of contact with the control members of the machine control panel. The first hinge portion is preferably integrally molded from a resilient plastic material. The first and second hinge portions are attached to their respective cabinet and closure lid by means of a locator stud and threaded fastener.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
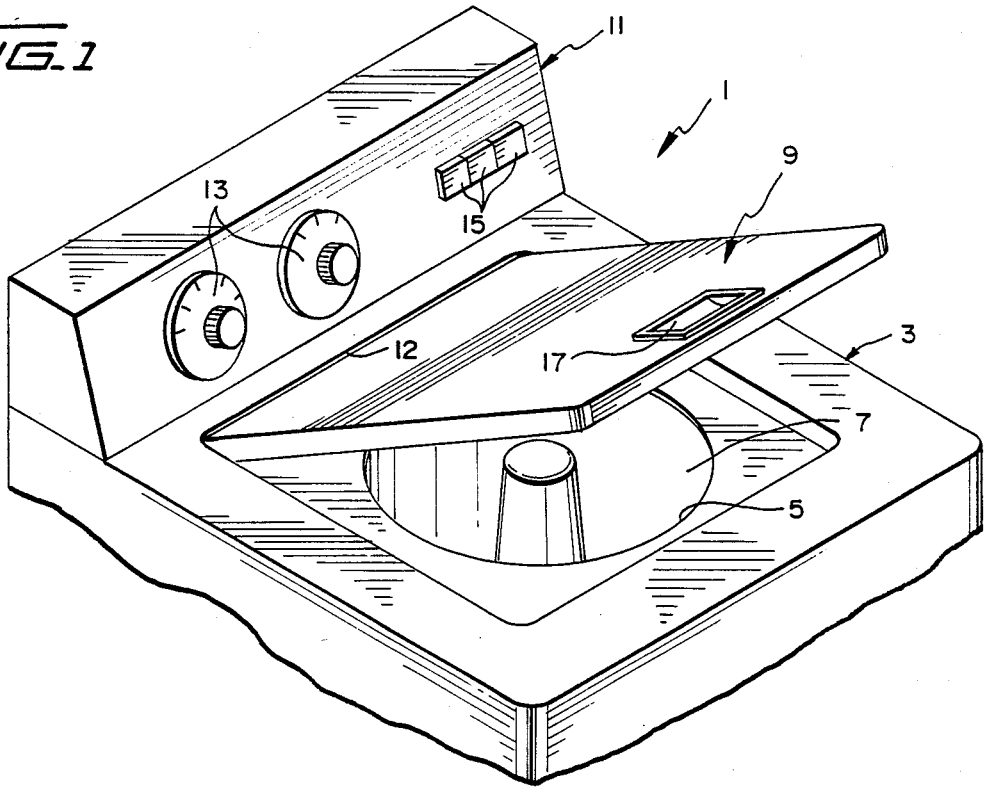
FIG. 1 is a partial perspective view of a conventional top-loading clothes washing machine having a rear control panel provided with forwardly extending control members and shown with the closure lid in a partially open position.

As shown in FIG. 1, a conventional top-loading clothes washing machine 1 includes a cabinet 3 having a top opening 5 for permitting access to the interior of a clothes basket 7. Opening 5 is provided with a closure lid 9 which is hinged along an edge 11 to the rear position of cabinet 3 for pivotal movement upwardly and rearwardly into a fully open position. The upper rear portion of cabinet 3 is also provided with a vertically extending control panel 11 having mounted thereon a plurality of control members 13 and 15, such as rotary knobs and push buttons, respectively. Members 13 and 15 are typically mounted in outwardly extending and substantially forwardly directed positions. Closure lid 9 is also provided with an appropriate handle means 17 to permit the opening and closing of lid 9.

Figure 2:
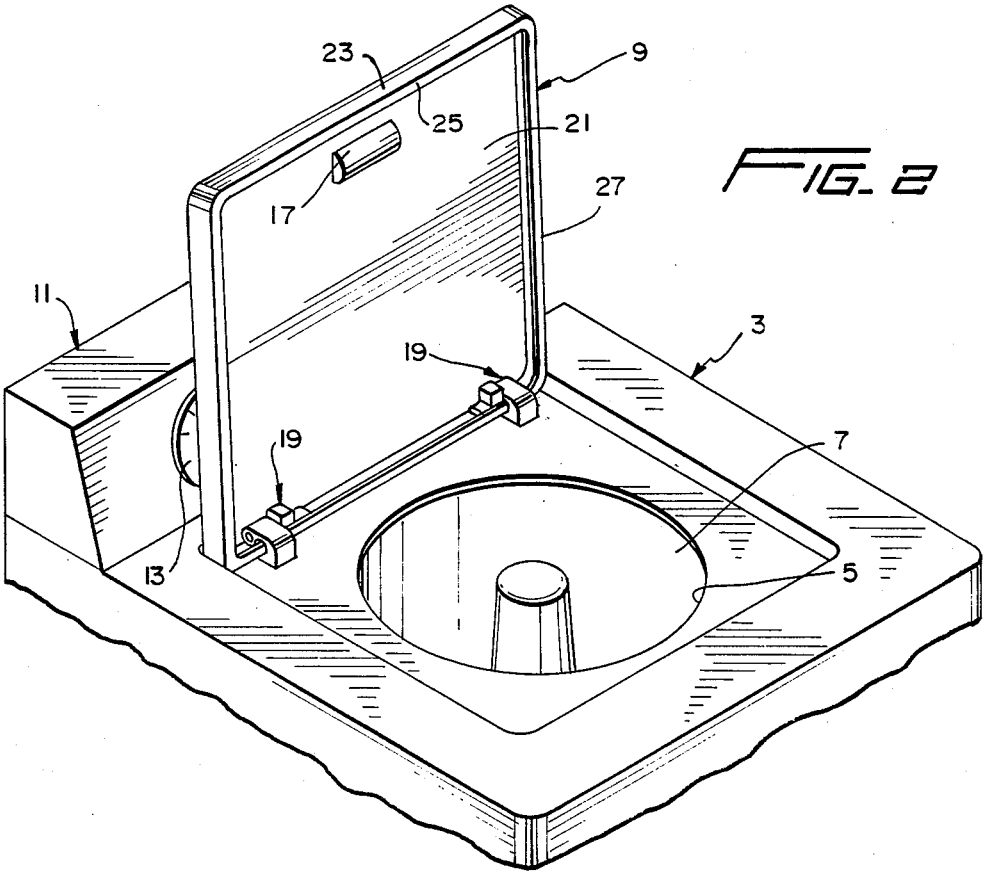
FIG. 2 is a partial perspective view of the machine depicted in FIG. 1, but shown with the closure lid attached to the machine cabinet and disposed in a releasable self-sustaining open position by a pair of hinge assemblies according to a preferred embodiment of the invention.

Closure lid 9 is depicted in FIG. 2 in a fully open position and pivotally secured to cabinet 3 by a pair of hinge assemblies 19 according to a preferred embodiment of the invention. By virtue of assemblies 19, and in a manner to be hereinafter detailed, lid 9 may be disposed in a releasable self-sustaining fully open position, extending substantially vertically above cabinet 3 and maintained out of contact with control members 13 and 15 of control panel 11. As further indicated in FIG. 2, the peripheral edge of lid 9 is in the form of a continuous inwardly directed channel defined by the outer peripheral portions of a central panel section 21, a depending peripheral flange 23 and a peripheral return flange 25. The intersection between flanges 23 and 25 form a peripheral radiused bearing section 27. Although bearing section 27 is shown to extend completely around the periphery of closure lid 9, it is to be understood that, for the practice of the invention, it is only required to provide lid 9 with bearing section 27, or its structural equivalent, at the vicinity of each hinge assembly 19.

Figure 3:
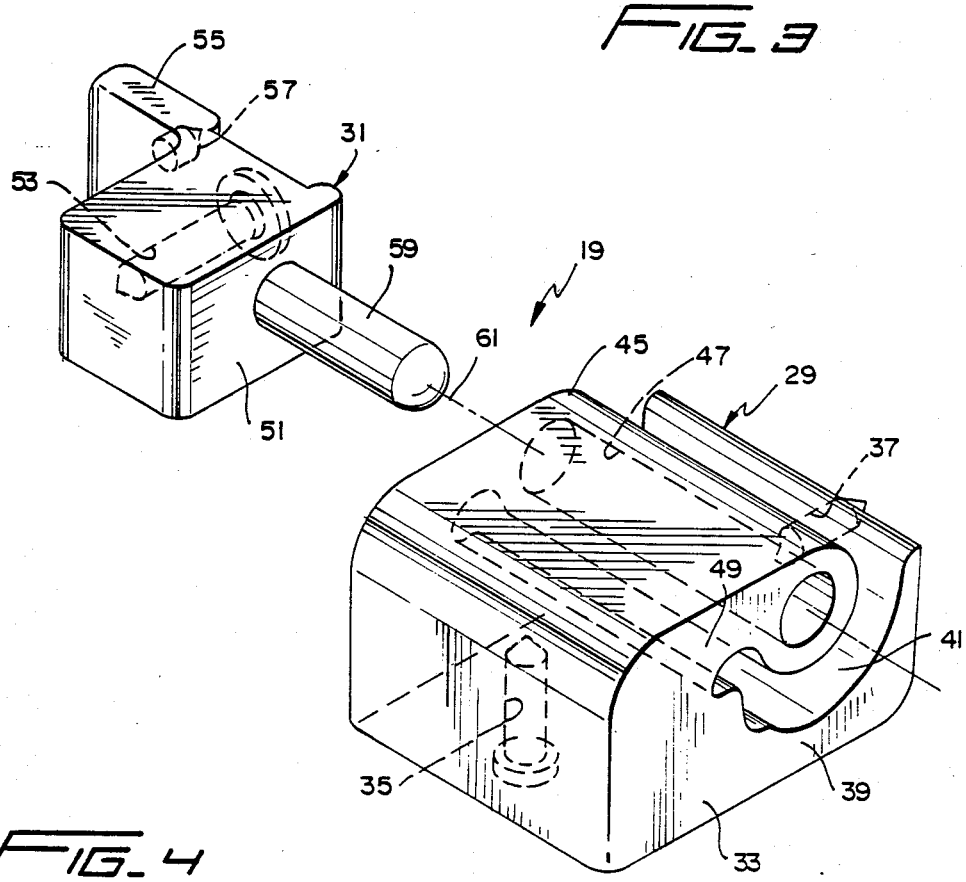
FIG. 3 is a perspective view showing a single hinge assembly, particularly depicting the first and second hinge portions forming the assembly and the manner in which a passageway in the first hinge portion receives a pivot pin of the second hinge portion.

The details of hinge assembly 19 shall now be described with reference to FIG. 3. As shown therein, assembly 19 includes a first hinge portion 29 and a second hinge portion 31 for respective attachment to cabinet 3 and closure lid 9 of machine 1. As previously shown in FIG. 2, a pair of assemblies 19 are utilized in an appropriately spaced disposition to secure closure lid 9 to cabinet 3.

First hinge portion 29 is integrally formed from a resilient rubber or plastic material, preferably by injection molding an appropriate plastic polymer. Hinge portion 29 includes a base 33 provided with a bore 35 formed therein for permitting attachment of hinge portion 29 to cabinet 3 by an appropriate threaded fastener. This may be realized by providing bore 35 with a threaded sleeve or other similar device. Hinge portion 29 is provided with an outwardly extending locator stud 37 for disposition within an aperture formed within a corresponding wall of cabinet 3 for the purpose of maintaining hinge portion 29 in proper alignment and preventing its rotation during its attachment to cabinet 3. Hinge portion 29 also includes a bearing member 39 which extends forwardly of base 33 and is provided with an upwardly directed curved bearing surface 41 which terminates in a landing 43, the latter having the general configuration of a radiused groove. A hub 45 provided with a longitudinal passageway 47 therethrough is disposed above bearing surface 41 and movably secured to base 33 by an integral web portion 49 which functions as a resilient hinge that permits hub 45 to pivot outwardly and inwardly with respect to bearing surface 41. As apparent from FIG. 3, the transverse cross-sectional configuration collectively defined by base 33, bearing surface 41, landing 43, hub 45 and passageway 47 is substantially uniform across the longitudinal width of hinge portion 29.

Second hinge portion 31 includes a base 51 provided with a bore 53 for receiving an appropriate threaded fastener to secure hinge portion 31 to the inner surface of depending flange 23 of closure lid 9. Bore 53 may also be provided with a threaded sleeve or similar device for this purpose. Base 51 includes an outwardly extending tab 55 provided with a locator stud 57 for engagement within a corresponding aperture formed in depending flange 23 for maintaining hinge portion 31 in alignment and preventing its rotation during attachment of hinge portion 31 to lid 9. An outwardly extending pivot pin 5 is carried by base 51 for insertion within passageway 47 of first hinge portion 29 to define a longitudinal axis of rotation 61 about which both hinge portion 31 and closure lid 9 may collectively pivot with respect to both hinge portion 29 and cabinet 3.

Figure 4:
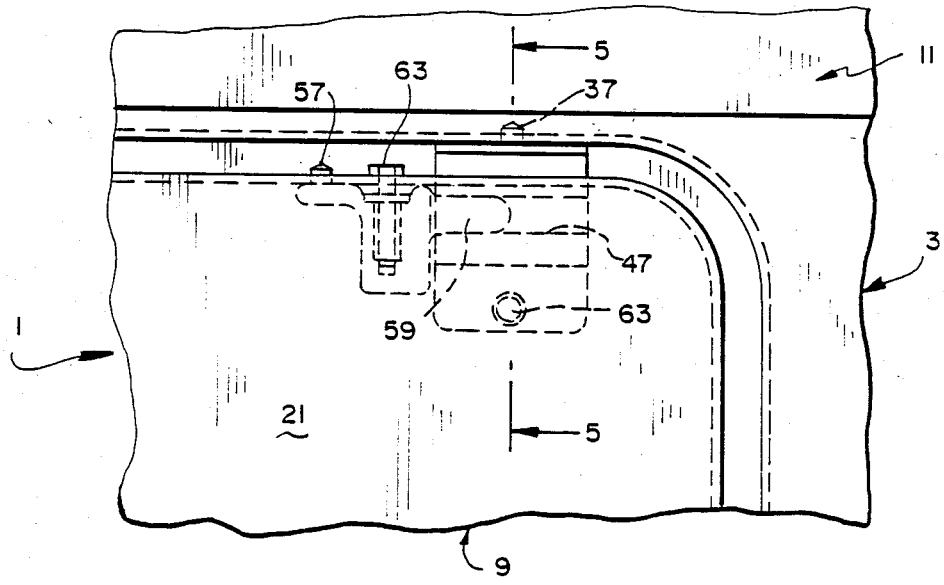
FIG. 4 is a top view of a single hinge assembly shown in FIG. 2 and depicted with the closure lid of the machine in a fully closed position.

Hinge assembly 19 is shown in its fully installed position in FIG. 4, with pivot pin 59 being disposed within passageway 47 and closure lid 9 in its fully closed position. First and second hinge portions 29 and 31 are shown attached to cabinet 3 and closure lid 9, respectively, by a pair of appropriate threaded fasteners 63. Locater studs 37 and 57 are also shown inserted through corresponding apertures formed in cabinet 3 and closure lid 9 for maintaining alignment of hinge portions 29 and 31 with respect to each other and both cabinet 3 and lid 9.

Figure 5:
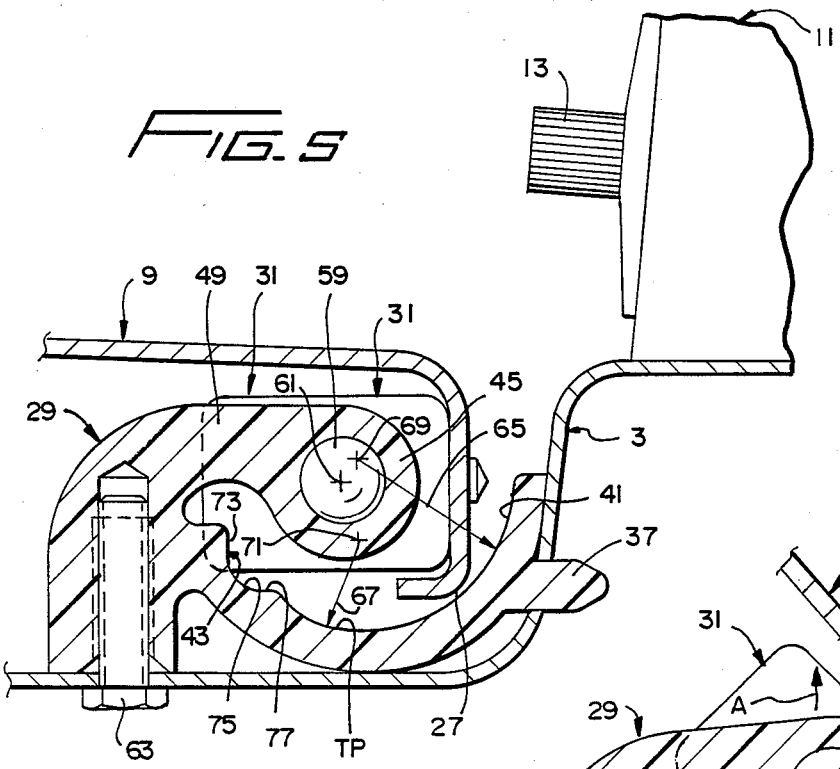
FIG. 5 is a cross-sectional view taken along the line 5—5 of FIG. 4, and particularly depicting the bearing section of the closure lid at the start of its transition from clearance to an interference fit with respect to the curved bearing surface of the second hinge portion.

Further details of first hinge portion 29 and the manner in which closure lid 9 is placed in a releasable self-sustaining open position shall now be described with reference to FIGS. 5–7. With initial reference to FIG. 5, closure lid 9 is shown in its fully closed position. The curvature of bearing surface 41 is defined by a first arc having a radius 65 and a second arc having a radius 67. The centers 69 and 71 of radii 65 and 67, respectively, are offset from axis of rotation 61. As also apparent from FIG. 5, radius 65 is larger than radius 67 so that an intersection of the arcs described thereby occur at a point TP wherein the arc of radius 65 is tangent to the arc of radius 67. Point TP is substantially in alignment with centers 69 and 71. By virtue of this configuration, it shall be noted that a clearance exists between radiused bearing section 27 and the initial portion of bearing surface 41 defined by radius 65. Thereafter, bearing surface 41 is defined by radius 67. As further noted, bearing surface 41 terminates in landing 43, the latter being defined by a vertical wall 73, an arcuate wall 75 and a horizontal wall 77. Arcuate wall 75 has a curvature which corresponds to the curvature of radiused bearing section 27.

Figure 6:
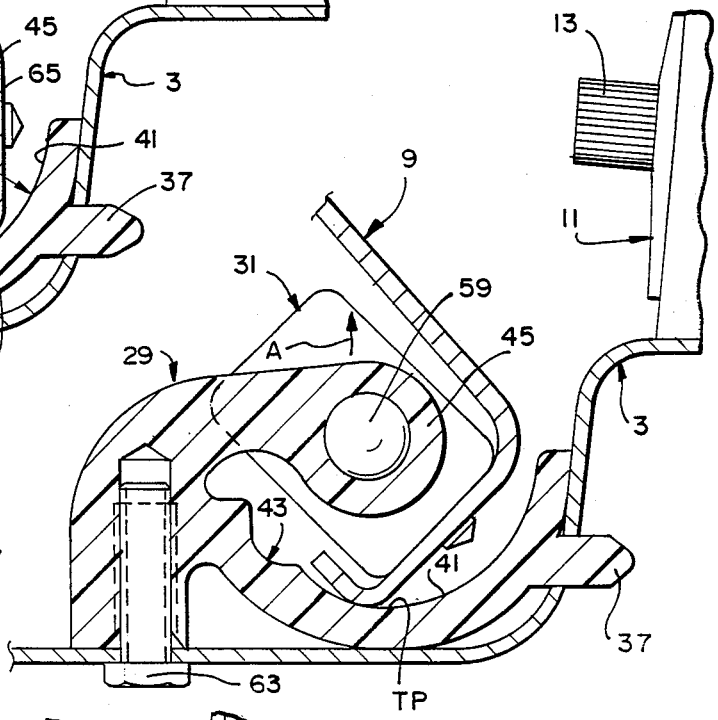
FIG. 6 is a partial cross-sectional view similar to FIG. 5, but depicting the closure lid in a partially open position wherein the bearing section of the closure lid is disposed in an interference fit against the curved bearing surface and causing the hub of the first hinge portion to be pivoted outwardly.

When closure lid 9 is pivoted about axis 61 into the partially open position shown in FIG. 6, it can be seen that bearing section 27 has traversed the clearance portion of bearing surface 41 defined by radius 65 and enters into an interference fit against that portion of surface 41 defined by radius 67 at point TP. This occurs because radius 67 is smaller than radius 65 and their respective centers 71 and 69 are offset from axis 61. Continued pivoting of lid 9 about axis 61 causes hub 45 and pivot pin 59 to collectively pivot upwardly and outwardly about resilient web 49 in the direction indicated by arrow A. Further pivoting of lid 9 about axis 61, as shown in FIG. 7, eventually disposes bearing section 27 within landing 43 wherein bearing section 27 engages arcuate wall 75, return flange 25 engages vertical wall 73 and depending flange 23 engages horizontal wall 77. When this occurs, hub 45 and pivot pin 59 are caused to pivot back downwardly and inwardly to substantially the original position shown in FIG. 5 because of the restoring force imparted by resilient web 49. As further apparent from FIG. 7, closure lid 9 is sustained in a fully open position by web 49 and the engagement of bearing section 27 in landing 43. This self-sustaining and substantially vertical position of closure lid 9 disposes same out of contact with control members 13 and 15 of control panel 11. As apparent, landing 43 provides a positive locking of closure lid 9 in its fully open position. However, it is understood that for certain applications of the invention, it may be desirable to eliminate landing 43 and form bearing surface 41 with only clearance and interference portions. In such case, the interference portion shall serve to sustain closure lid 9 in its fully open position in conjunction with the restoring force of web portion 49.

Figure 7:
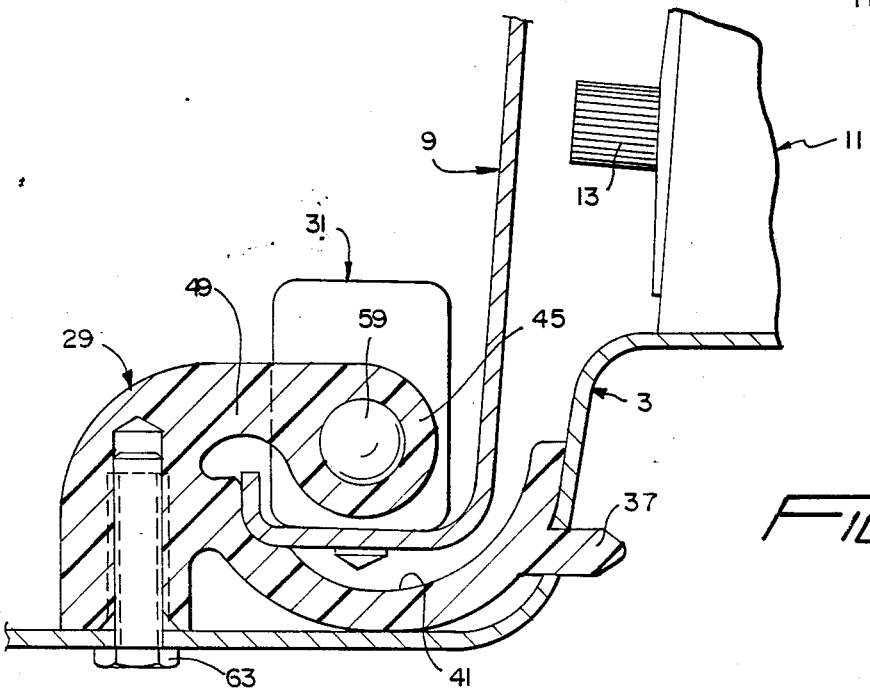
FIG. 7 is a partial cross-sectional view similar to FIG. 6, but depicting the closure lid in its fully open position, with the bearing section engaged within the landing at the end of the curved bearing surface and the hub pivoted inwardly to its substantially original position, thereby placing the closure lid in a releasable self-sustaining open position and out of contact with the control members of the machine control panel.

When it is desired to release closure lid 9 from the self-sustaining fully open position shown in FIG. 7, it is only necessary to apply sufficient force to cause pivoting of lid 9 about axis 61 in the reverse direction so that the inherent resilient holding force of web 49 is overcome and bearing section 27 is released from its engagement within landing 43. This shall result in the outward pivoting of hub 45 and pivot pin 59 until bearing section 27 passes point TP and into the region of clearance with bearing surface 41 defined by radius 65. Continued pivoting of lid 9 in this manner permits its final disposition in the fully closed position shown in FIG. 5.

The invention therefore provides a hinge assembly 19 which is highly advantageous in that first hinge portion 29, which provides the dual function of serving as a stop for preventing closure lid 9 from contacting control members 13 and 15 of control panel 11 and as a means for securing closure 9 in a self-sustaining fully opened position, may be easily and integrally molded from plastic in a single piece. The installation of assembly 19 only requires the use of two threaded fasteners 63, and the dispositions of first and second hinge portions 29 and 31 with respect to their attachment to cabinet 3 and closure lid 9 render assembly 19 almost entirely hidden from view when closure lid 9 is disposed in its fully closed position.

Although hinge assembly 19 has been described in conjunction with closure lid 9 of clothes washing machine 1, it is clear that assembly 19 may also be advantageously utilized with other types of closure members and cabinets.

It is to be understood that the form of the invention herein shown and described is to be taken as a preferred embodiment of the same, and that various changes in material, composition, size, configuration and arrangement of parts may be resorted to by one of ordinary skill in the art without departing from the spirit of the invention or scope of the subjoined claims.

We claim:

1. A hinge assembly for pivotally connecting a closure member provided with a bearing section along an edge thereof to an associated cabinet and maintaining the closure member in a releasable self-sustaining open position, which assembly comprises:

a) a first hinge portion for attachment to the cabinet and including a base, a bearing surface and a hub;

b) a pivot pin for attachment to the closure member;

c) the hub being connected to the base by a resilient hinge means for pivotal movement and including a passageway for receiving the pivot pin and permitting the closure member to pivot about an axis of rotation defined by the pivot pin between closed and open positions;

d) the bearing surface including an interference portion engageable by the bearing section for creating an interference fit therebetween during pivoting of the closure member; and e) wherein when the bearing section engages the interference portion, the hub is pivoted outwardly against the restoring force of the hinge means until the bearing section passes the interference portion, thereby causing the hub to pivot back inwardly under the restoring force for either sustaining the closure member in the open position or permitting the closure member to be disposed in the closed position.

2. The hinge assembly of claim 1 wherein the bearing surface further includes a landing portion engageable by the bearing section for securing the closure member in the open position.

3. The hinge assembly of claim 2 wherein the landing includes an arcuate wall of radiused configuration for engagement by a bearing section having a corresponding configuration.

4. The hinge assembly of claim 1 wherein the first hinge portion is integrally formed of resilient material.

5. A hinge assembly for pivotally connecting a closure member provided with a bearing section along an edge thereof to an associated cabinet and maintaining the closure member in a releasable self-sustaining open position, which assembly comprises:

a) a first hinge portion for attachment to the cabinet and including a base, a bearing surface and a hub;

b) the hub being connected to the base by a resilient hinge means for pivotal movement and including a passageway for receiving a pivot pin carried by the closure member for permitting the closure member to pivot about an axis of rotation defined by the pivot pin between closed and open position;

c) the bearing surface being of a curved configuration defined by an arc of a first radius forming a clearance portion and an arc of a second radius forming an interference portion, the first radius being larger than the second radius, the arc of the first radius being tangent to the arc of the second radius, and the interference portion being engageable by the bearing section for creating an interference fit therebetween during pivoting of the closure member; and d) wherein when the bearing section engages the interference portion, the hub is pivoted outwardly against the restoring force of the hinge means until the bearing section passes the interference portion, thereby causing the hub to pivot back inwardly under the restoring force for either sustaining the closure member in the open position or permitting the closure member to be disposed in the closed position.

6. The hinge assembly of claim 5 wherein the centers of the first and second radii are located on a common line that is offset from the axis of rotation.

7. A hinge assembly for pivotally connecting a closure member provided with a bearing section along an edge thereof to an associated cabinet and maintaining the closure member in a releasable self-sustaining open position, which assembly comprises:

a) a first hinge portion for attachment to the cabinet and including a base, a bearing surface and a hub;

b) the hub being connected to the base by a resilient hinge means for pivotal movement and including a passageway;

c) a second hinge portion for attachment to the closure member and a pivot pin carried by the second hinge portion for disposition within the passageway of the hub and permitting the closure member to pivot about an axis of rotation defined by the pivot pin between closed and open positions;

d) the bearing surface including an interference portion engageable by the bearing section for creating an interference fit therebetween during pivoting of the closure member; and e) wherein when the bearing section engages the interference portion, the hub is pivoted outwardly against the restoring force of the hinge means until the bearing section passes the interference portion, thereby causing the hub to pivot back inwardly under the restoring force for either sustaining the closure member in the open position or permitting the closure member to be disposed in the closed position.

8. The hinge assembly of claim 7 wherein the first and second hinge portions each includes at least one locator stud for engagement within a corresponding aperture formed in the respective cabinet and closure member, and a threaded bore for permitting attachment thereof to the respective cabinet and closure member by a threaded fastener.

9. A closure assembly for the cabinet of a washing machine comprising:

a) a closure member including a bearing section along an edge thereof;

b) a first hinge portion for attachment to the cabinet and including a base, a bearing surface and a hub;

c) the hub being connected to the base by a resilient hinge means for pivotal movement and including a passageway;

d) a second hinge portion carried by the closure member and including a pivot pin for disposition within the passageway of the hub;

e) the bearing surface including an interference portion engageable by the bearing section for creating an interference fit therebetween during pivoting of the closure member; and f) wherein when the bearing section engages the interference portion, the hub is pivoted outwardly against the restoring force of the hinge means until the bearing section passes the interference portion, thereby causing the hub to pivot back inwardly under the restoring force for either sustaining the closure member in the open position or permitting the closure member to be disposed in the closed position.

10. The closure assembly of claim 9 wherein the bearing surface further includes a landing portion engageable by the bearing section for securing the closure member in the open position.

11. The closure assembly of claim 10 wherein the bearing section is of a radiused configuration and the landing includes an arcuate wall of corresponding configuration.

12. The closure assembly of claim 9 wherein the bearing surface is of a curved configuration defined by an arc of a first radius forming a clearance portion and an arc of a second radius forming the interference portion, the first radius being larger than the second radius and the arc of the first radius being tangent to the arc of the second radius.

13. The closure assembly of claim 12 wherein the centers of the first and second radii are located on a common line that is offset from the axis of rotation.

14. The closure assembly of claim 9 wherein the first and second hinge portions each includes at least one locator stud for engagement within a corresponding aperture formed in the respective cabinet and closure member, and a threaded bore for permitting attachment thereof to the respective cabinet and closure member by a threaded fastener.

* * * * *